US007460070B2

(12) United States Patent
Chen et al.

(10) Patent No.: US 7,460,070 B2
(45) Date of Patent: Dec. 2, 2008

(54) CHIP ANTENNA

(75) Inventors: Yen-Ming Chen, Taipei (TW); Chao-Wei Wang, Taipei (TW); Chang-Fa Yang, Taipei (TW); Shun-Iian Lin, Taipei (TW); Chuan-Lin Hu, Sijhih (TW); Chang-Lun Liao, Sijhih (TW); Yu-Wei Chen, Sijhih (TW)

(73) Assignee: Chant Sincere Co., Ltd., Taipei Hsien (TW)

( * ) Notice: Subject to any disclaimer, the term of this patent is extended or adjusted under 35 U.S.C. 154(b) by 86 days.

(21) Appl. No.: 11/598,019

(22) Filed: Nov. 13, 2006

(65) Prior Publication Data

US 2007/0115182 A1 May 24, 2007

(30) Foreign Application Priority Data

Nov. 14, 2005 (TW) ..... 94139939 A

(51) Int. Cl.
*H01Q 1/38* (2006.01)

(52) U.S. Cl. ..... 343/700 MS; 343/895

(58) Field of Classification Search ..... 343/700 MS, 343/702, 895

See application file for complete search history.

(56) References Cited

U.S. PATENT DOCUMENTS 6,653,986 B2 * 11/2003 Watada et al. ..... 343/895
6,894,646 B2 * 5/2005 Washiro et al. ..... 343/700 MS

FOREIGN PATENT DOCUMENTS

| | | |
|---|---|---|
| TW | M253070 | 3/1993 |
| TW | 491417 | 12/2000 |
| TW | 480773 | 3/2002 |
| TW | 241052 B | 10/2005 |

* cited by examiner

*Primary Examiner*—Tho G Phan
(74) *Attorney, Agent, or Firm*—Muncy, Geissler, Olds & Lowe, PLLC

(57) ABSTRACT

A chip antenna has a dielectric material layer, a first meandered strip, a second meandered strip and several bended strips. The first meandered strip is meandered in one direction and disposed on the dielectric material layer. The second meandered strip is meandered in another direction and disposed on the dielectric material layer. The first meandered strip is connected to the second meandered strip. The bended strips are connected to the turns of the meandered strips.

18 Claims, 15 Drawing Sheets

CHIP ANTENNA

RELATED APPLICATIONS

The present application is based on, and claims priority from, Taiwan Application Serial Number 94139939, filed Nov. 14, 2005, the disclosure of which is hereby incorporated by reference herein in its entirety.

BACKGROUND OF THE INVENTION

1. Field of Invention

The invention relates to an antenna and, in particular, to a chip antenna having a single feed and multiple meandered strips.

2. Related Art

Due to the rapid development in wireless communications, various electronic devices (such as mobile phones, computers, networks, etc) have been equipped with wireless communication functions for signal transmissions. The primary emission and receiving device for wireless communications is the signal transceiver and the antenna installed thereon. As modem electronic devices become more compact and lighter, conventional antennas (e.g., pole antennas, Yagi antennas, parabolic antennas, etc) cannot satisfy the new requirements.

Several small antennas have been proposed in the prior art. For example, The Taiwan Patent post-granted publication No. 491417 discloses an internal vertical dual-frequency antenna, which is a microstrip antenna standing vertically inside the communication apparatus. Taiwan Patent post-granted publication No. 480773 discloses a chip meandered antenna with multiple dielectric material layers, which is a three-dimensional meandered antenna whose ceramic dielectric material layer is prepared using the low-temperature co-fire technology. The antenna structure with a wide and broad band disclosed in Taiwan Utility Model Patent No. M253070 is an antenna having a crack near its front end. An inductor is disposed inside the crack and connected to the antenna circuit. Good matching impedance can be thus obtained.

Since the above-mentioned antennas have smaller sizes, they have become indispensable components in communication products. However, they still have the drawbacks of sizeable volumes, insufficient efficiencies, and high production costs.

SUMMARY OF THE INVENTION

An objective of the invention is to provide a chip antenna that utilizes a special circuit structure to achieve the goals of reducing the antenna size and increasing its efficiency.

According to a preferred embodiment of the invention, the chip antenna includes a dielectric material layer, a first meandered strip, a second meandered strip, and several bended strips. The first meandered strip is meandered in a first direction and disposed on the dielectric material layer. The second meandered strip is meandered in another direction and disposed on the dielectric material layer. The first meandered strip is connected to the second meandered strip. The bended strips are connected to the turns on one same side of the meandered strips.

The axial ratio of the disclosed chip antenna can be controlled by tuning the strip size ratio along different directions. The strip widths, numbers of turns, and intervals of the two meandered strips can be used to adjust the bandwidth and frequency response of the chip antenna. Besides, the electromagnetic (EM) mutual coupling effect between the bended strips and the first meandered strip helps further reducing the size of the chip antenna. In practice, the disclosed chip antenna may even have multiple frequency bands and even wide bands that are suitable for global positioning systems (GPS), ISM wireless communications (e.g., IEEE802.11a/b/g, Bluetooth, etc), or other different applications.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

The invention connects meandered strips that are meandered along different direction and several bended strips to form an antenna. The bended strips are connected to specific locations on one of the meandered strip to reduce the antenna size. Using this antenna structure, a person skilled in the art can control the axial ratio of the antenna by tuning the strip size ratio along the different direction. The person can even adjust its bandwidth and frequency response by controlling the strip widths, intervals, numbers of turns of the meandered strips. Moreover, two or more of the above-mentioned multiple meandered strip sets can be stacked together to change the working frequency band, increase the bandwidth or reduce the size, and reduce the production cost.

To simplify the explanation for the technical features of the invention, the following embodiments use a single plane with two multiple meandered strip sets meandering in different directions as an explicit example. A skilled person can readily understand that an antenna with two or more multiple meandered strip sets is also considered as part of the invention.

FIRST EMBODIMENT

In this embodiment, two meandered strips meandering in directions and several bended strips are connected to a form a chip antenna. A skilled person can change the strip widths, intervals, numbers of turns, and size ratio of the different meandered strips to adjust the frequency band, bandwidth, and axial ratio of the antenna.

Figure 1A:
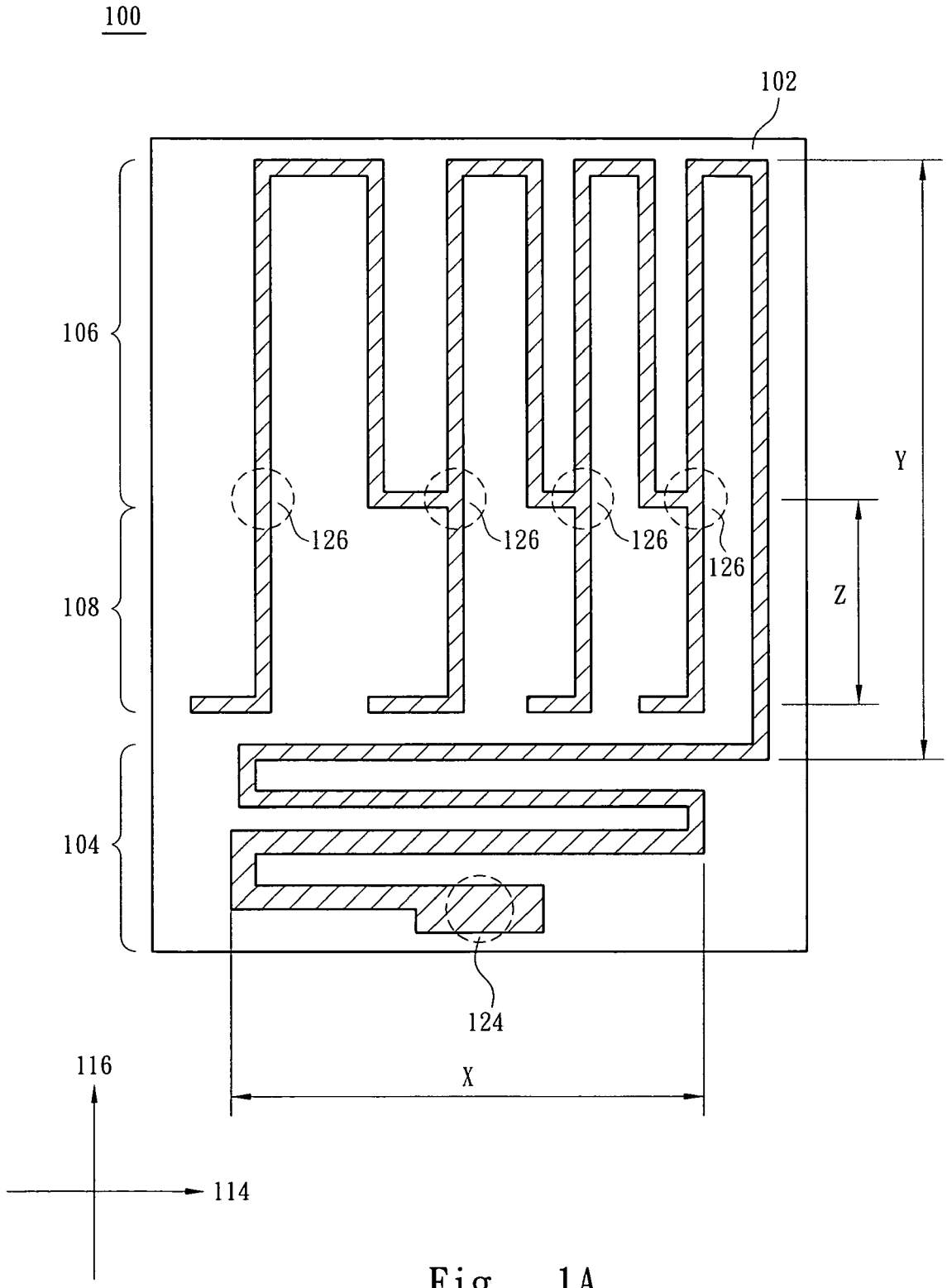
FIG. 1A is a schematic view of the first embodiment of the invention.

As shown in FIG. 1A, the chip antenna 100 includes a dielectric material layer 102, a first meandered strip 104, a second meandered strip 106, and several bended strips 108. The first meandered strip 104 is meandered in a first direction 114 and disposed on the dielectric material layer 102. The second meandered strip 106 is meandered in the second direction 116 and disposed on the dielectric material layer 102. The first meandered strip 104 and the second meandered strip 106 are connected. The bended strips 108 are connected to several turns 126 on one same side of the second meandered strip 106.

More explicitly, the first meandered strip 104 has several U-shaped meandered sub-strips, arranged in parallel along the second direction 116 and connected in series. The second meandered strip 106 also includes several U-shaped meandered sub-strips, arranged in parallel along the first direction 114 and connected in series. Turns on the same side of second meandered strip 106, such as the turns 126 between the first and second meandered strips 104, 106 in FIG. 1A, extend out to connect to several inversed L-shaped bended strips 108.

According to other embodiments of the invention, the first and second meandered strips 104, 106 may contain other different shapes of meandered sub-strips besides the U-shaped ones. The first direction 114 is essentially perpendicular to the second direction 116; but the perpendicular relation is not necessary. Moreover, the bended strips 108 can have an inversed L shape or some other shape.

The chip antenna 100 has its feed at the end 124 of the first meandered strip 104. The first meandered strip 104, the second meandered strip 106, and the bended strips 108 may have the same or different strip widths and intervals. The strip widths and intervals of the different meandered sub-strips in the first meandered strip 104 can be the same or different. The strip widths and intervals of the different meandered sub-strips in the second meandered strip 106 can be the same or different. The strip widths of the bended strips 108 can be the same or different. The intervals between them and the first meandered strip 104 can be the same or different.

The dielectric material layer 102 can be made of a dielectric or insulating material, such as a PCB or ceramic material. The first and second meandered strips 104, 106 and the bended strips 108 can be made of a metal, alloy, or other conductive material. For example, they can be made of copper. In an embodiment of the invention, the first and second meandered strips 104, 106 and the bended strips 108 are further covered with a protection layer or another dielectric material layer the same as or different from the dielectric material layer 102. For example, the meandered and bended strips are embedded into the dielectric material by insert molding. Not only does this method protect those strips from damages, it also reduces the strip size of the chip antenna 100 using the dielectric material.

On the other hand, the experimental results of the embodiments show that the properties and performance of the chip antenna 100 depend upon different conditions. The following paragraphs explain the relationships between the conditions and the antenna properties.

For example, the strip widths of the first meandered strip 104 and the second meandered strip 106 can be used to adjust the bandwidth of the chip antenna 100. The ratio X/Y between the size X of the first meandered strip 104 in the first direction 114 and the size Y of the second meandered strip 106 plus the bended strips 108 in the second direction 116 can be used to control the axial ratio of the chip antenna 100, controlling the axial polarization thereof.

Moreover, the number of turns in the first meandered strip 104, which is also the number of meandered sub-strips thereof, can be used to shift the frequency response of the chip antenna 100. The number of turns in the second meandered strip 106, which is also the number of meandered sub-strips thereof, can be used to increase the frequency response of the chip antenna 100, thereby increasing its bandwidth. The intervals between the turns of the second meandered strip 106, which are the intervals between different meandered sub-strips, can be used to adjust the frequency responses for a continuous resonance bandwidth.

Besides, using the EM mutual coupling effect between the bended strips 108 and the first meandered strip 104, the size of the chip antenna 100 can be reduced, changing the properties or effects thereof. FIGS. 1B to 1E show the frequency response of the return loss in several different experiments for the chip antenna in FIG. 1A. The vertical axis is the antenna return loss in units of dB; and the horizontal axis is the antenna frequency in units of GHz.

These experiments all have the same antenna structure as FIG. 1A. They have different intervals between the bended strips 108 and the first meandered strip 104, producing different EM mutual coupling effects. More explicitly, the strip widths of the first meandered strip 104, the second meandered strip 106, and the bended strips 108 in these experiments are all 0.2 mm. The sizes X of the second meandered strip 106 in the first direction 114 are all 7.2 mm. The sizes Y of the second meandered strip 106 plus the bended strips 108 in the second direction 116 are all 9.8 mm.

Figure 1B:
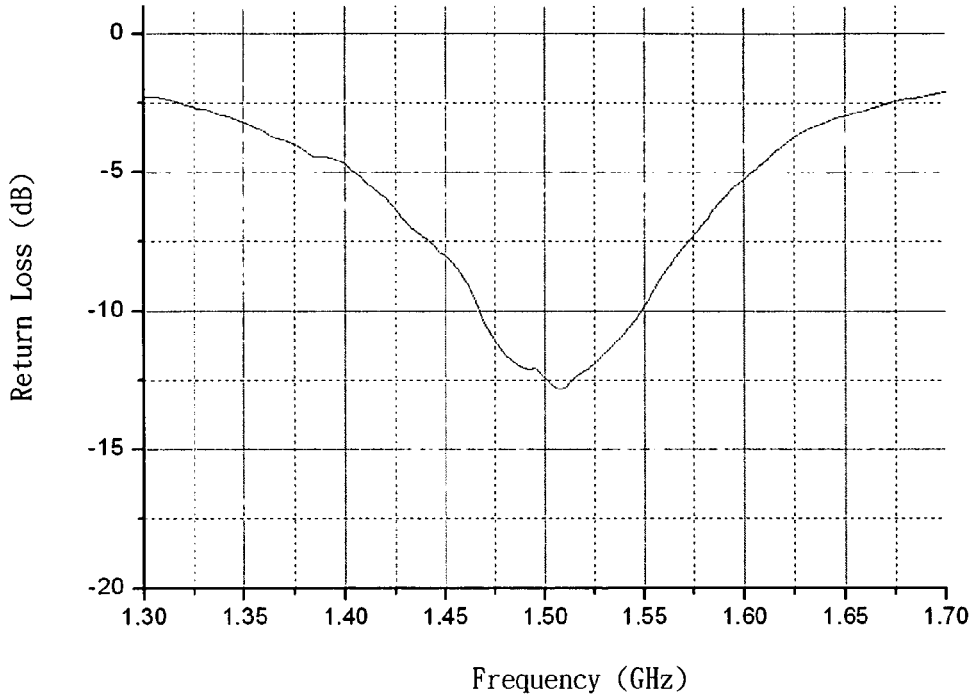
FIGS. 1B to 1E show the frequency response of the return loss in several different experiments of the chip antenna in FIG. 1A.
Figure 1C:
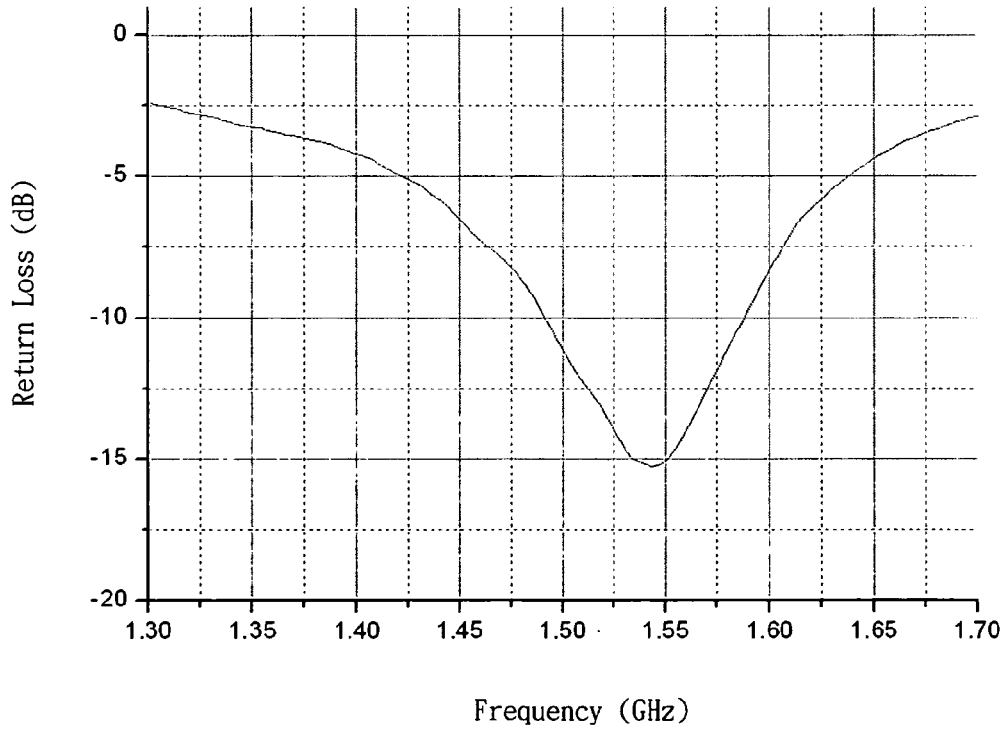
Figure 1D:
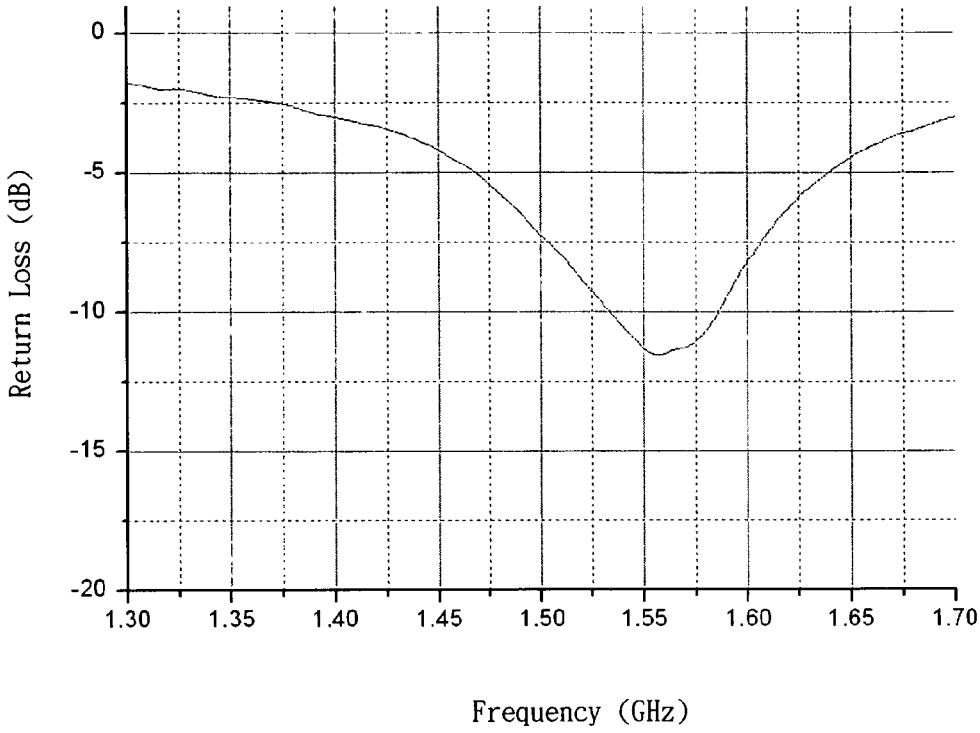
Figure 1E:
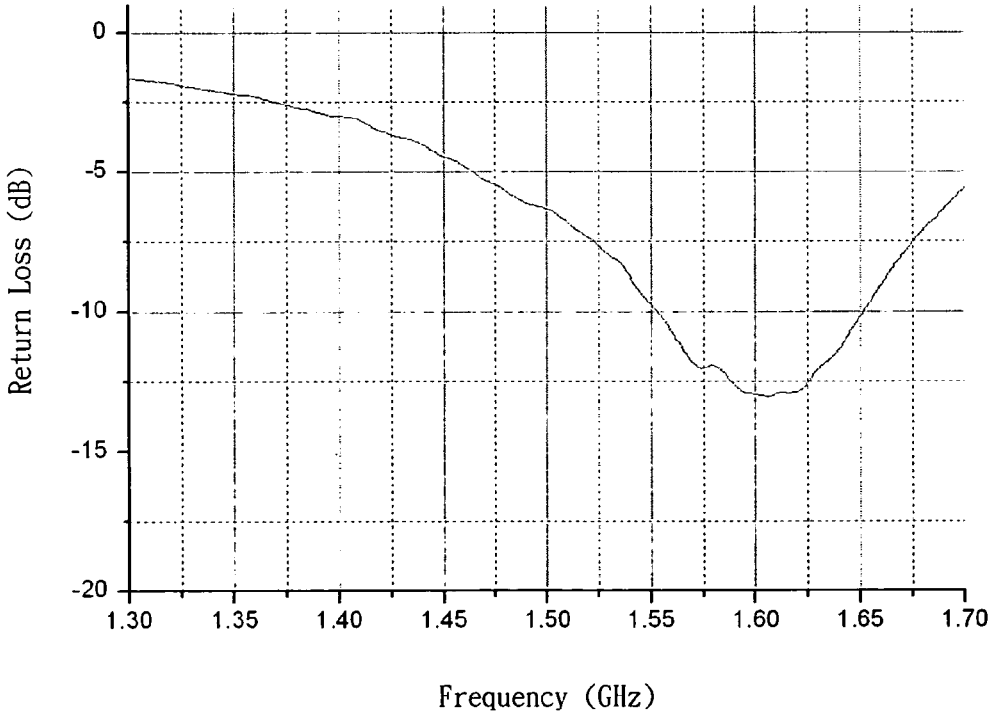

The size Z of the bended strips 108 in FIG. 1B in the second direction 116 is 1.6 mm. The size Z of the bended strips 108 in FIG. 1C in the second direction 116 is 2.0 mm. The size Z of the bended strips 108 in FIG. 1D in the second direction 116 is 2.4 mm. The size Z of the bended strips 108 in FIG. 1E in the second direction 116 is 2.8 mm. Different EM mutual coupling effects are produced because of bended strips with the different values of Z in these experiments. Therefore, the frequency response diagrams in FIGS. 1B to 1E are all different. The response frequency moves toward high frequencies as the intervals reduce. As shown in the drawings, 1.51 GHz in FIG. 1B gradually moves to 1.61 GHz in FIG. 1E.

A person skilled in the art can adjust the above-mentioned conditions in practice to obtain desired antenna properties or effects (e.g., different bandwidths or bands). For example, the first embodiment can be tuned appropriately to achieve multiple or wide frequency bands. They can be suitable for the GPS, ISM wireless communications, or other antenna applications.

Only one multiple meandered strip set, including the meandered strips 104, 106 and the bended strips 108, is disposed on a single surface of the dielectric material layer 102 in the embodiment of FIG. 1A. However, it should be emphasized that one multiple meandered strip set can be disposed on each of the two surfaces of the same dielectric material layer. They can be the same or different in order to change the working frequency, increase the bandwidth or reduce the antenna size, and reduce the production. Likewise, two or more multiple meandered strip sets can be stacked together to achieve better radiation fields or effects.

Figure 1F:
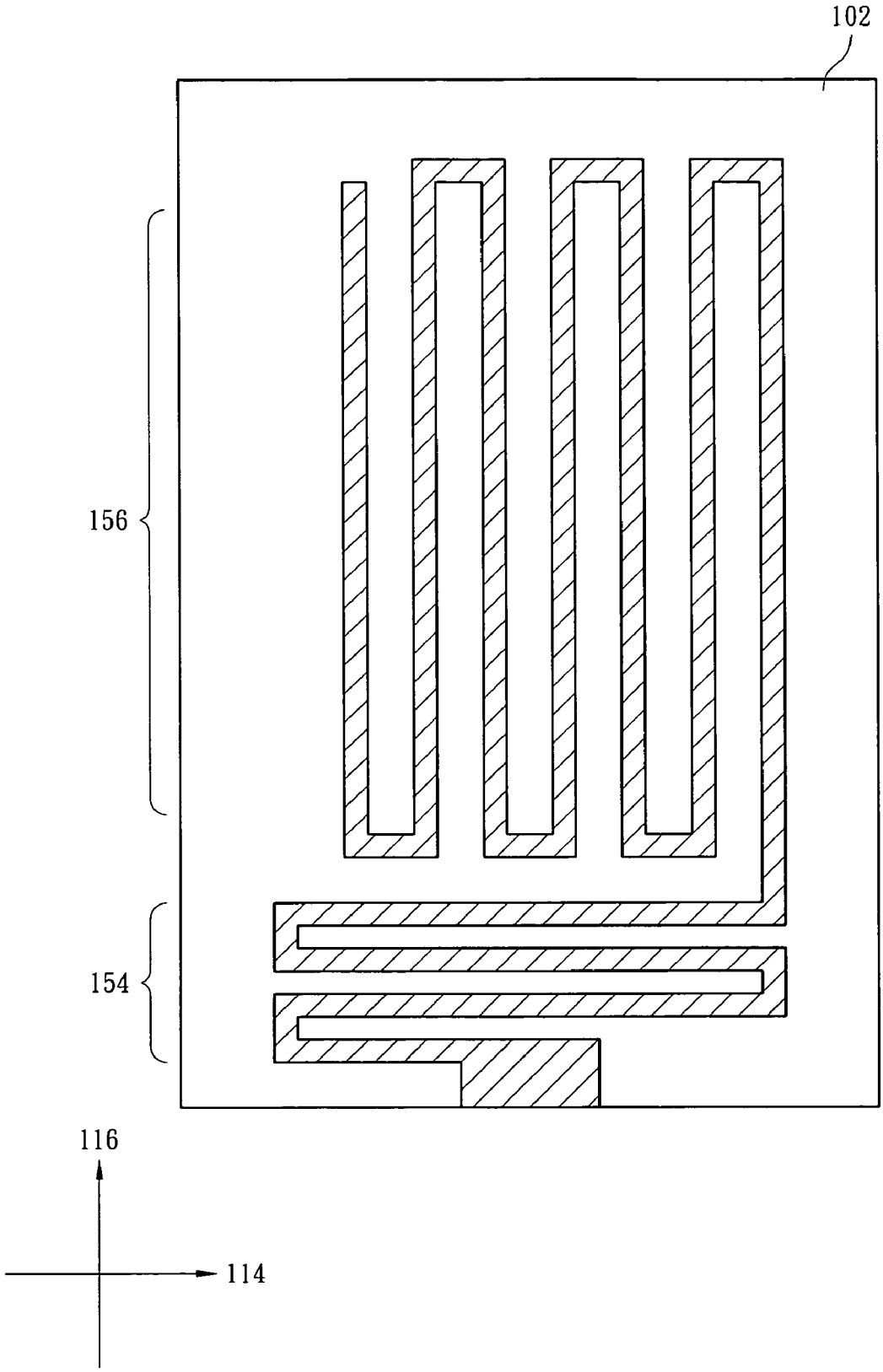
FIG. 1F is a schematic view of another embodiment of the invention.

FIG. 1F depicts another embodiment of the invention. One surface of its dielectric material layer (e.g., the front surface) has the multiple meandered strip set as shown in FIG. 1A, whereas the other surface (e.g., the back surface) has the other multiple meandered strip set as shown in FIG. 1F. The two multiple meandered strip sets are different. In this embodiment, a third meandered strip 154 is meandered in the first direction 114 and disposed on the back surface of the dielectric material layer 102. A fourth meandered strip 156 is meandered in the second direction 116 and disposed on the back surface of the dielectric material layer 102. The third meandered strip 154 and the fourth meandered strip 156 are connected.

Figure 1G:
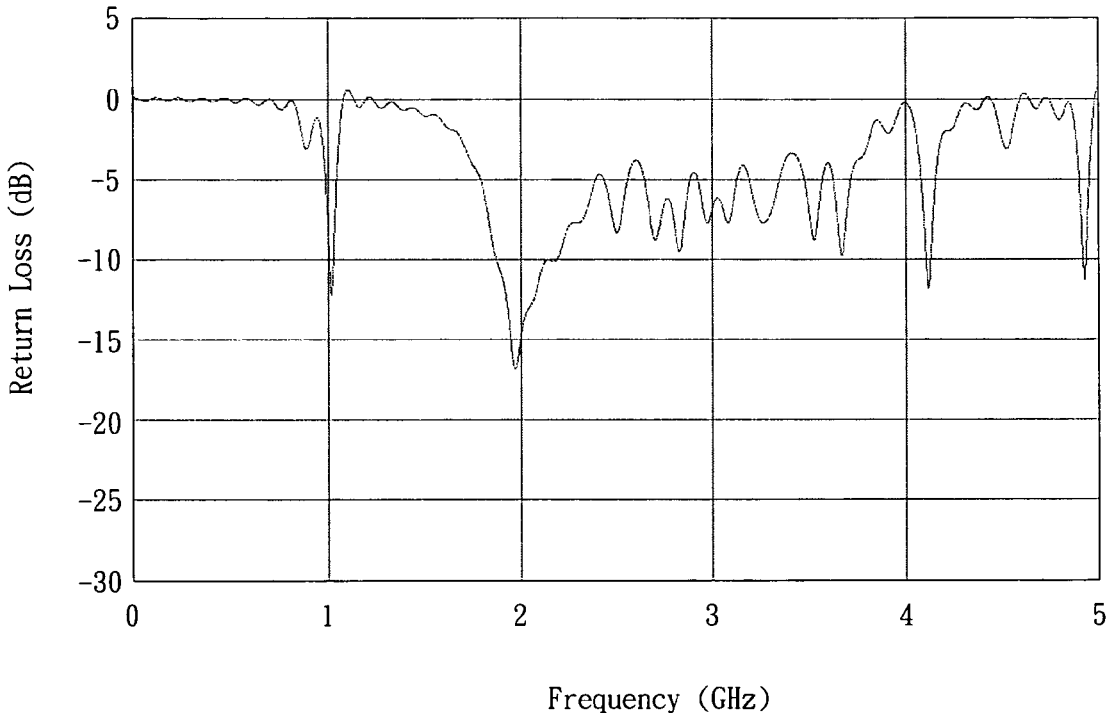
FIG. 1G shows the frequency response of the return loss for FIG. 1F.

FIG. 1G shows the frequency response of the return loss for the chip antenna in FIG. 1F. The vertical axis is the antenna return loss in units of dB; and the horizontal axis is the antenna frequency in units of GHz. The strip widths of the first meandered strip 104, the second meandered strip 106, the bended strips 108, the third meandered strip 154, and the fourth meandered strip 156 are all 0.2 mm. The size of the second meandered strip 106 in the first direction 114 is 12 mm. The total size of the first meandered strip 104, the second meandered strip 106, and the bended strip 108 in the second direction 116 is 18 mm. The size of the fourth meandered strip 156 in the firs direction 114 is 12 mm. The total size of the third meandered strip 154 and the fourth meandered strip 156 in the second direction 116 is 18 mm. As shown in FIG. 1G, the frequency range of the −10 dB return loss of the chip antenna satisfy the reception requirements of the GPS and ISM wireless communications.

SECOND EMBODIMENT

In this embodiment, the strip widths, intervals, numbers of turns, and shapes of the meandered strips are varied to adjust the frequency range and bandwidth of the chip antenna.

Figure 2A:
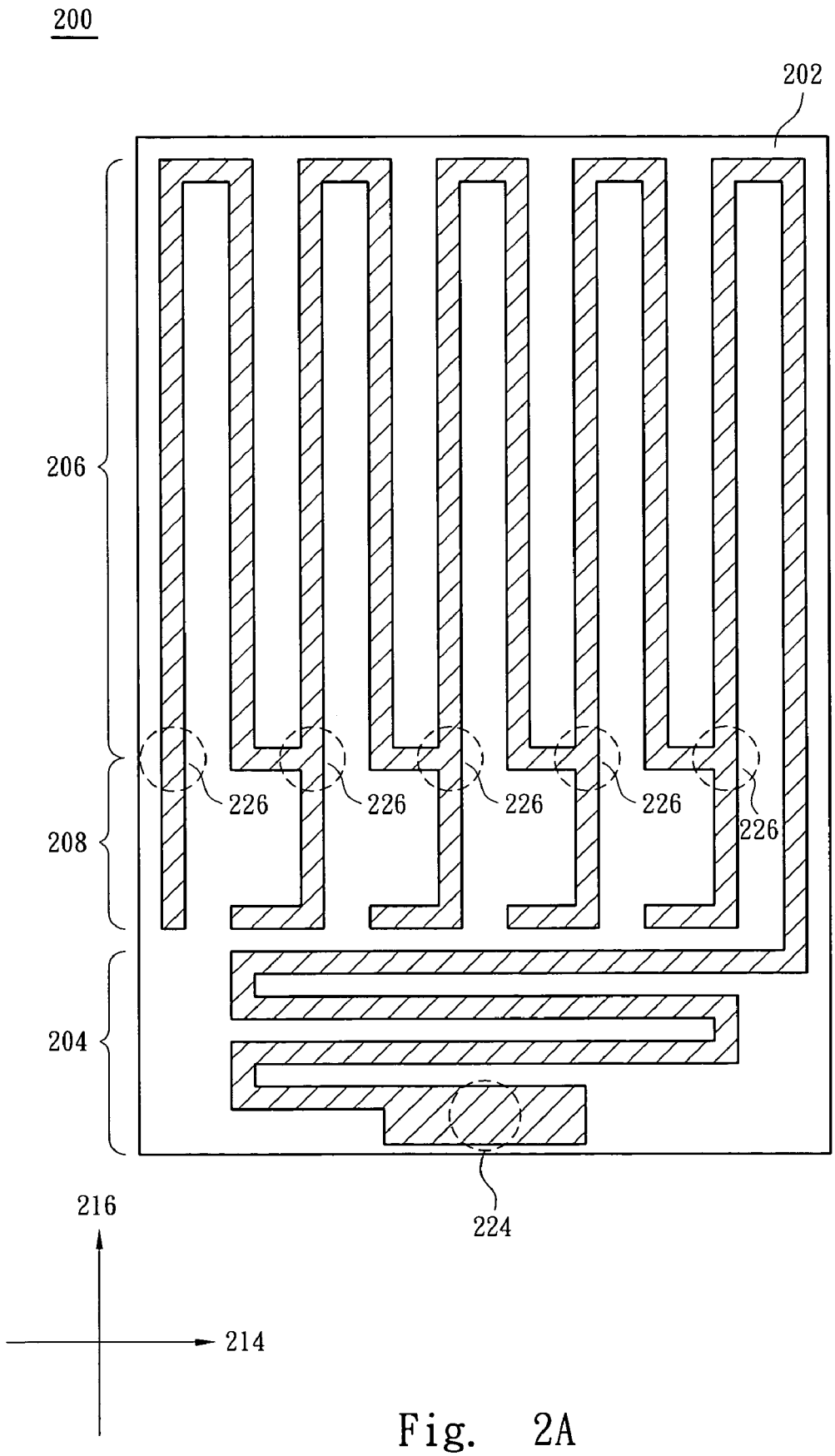
FIG. 2A is a schematic view of the second embodiment of the invention.

As shown in FIG. 2A, the meandered strips in the current embodiment have different strip widths, intervals, numbers of turns, and shapes from those in the first embodiment. Moreover, the sizes of the meandered strips and the bended strips are different from those in the first embodiment.

As shown in the drawing, the chip antenna 200 has a dielectric material layer 202, a first meandered strip 204, a second meandered strip 206, and several bended strips 208. The first meandered strip 204 and the second meandered strip 206 are connected. The bended strips 208 are connected to several turns 226 on one same side of the second meandered strip 206. Some differences from the first embodiment include that the second meandered strip 206 in the second embodiment has an additional U-shaped meandered sub-strip, and that the ending straight part of the additional U-shaped meandered sub-strip extends toward the first meandered strip 204 by a length roughly equal to the bended strips 208.

The chip antenna 200 has its feed on one end 224 of the first meandered strip 204. The strip widths and intervals of the different meandered sub-strips of the first meandered strip 204 can be the same or different. The strip widths and intervals of the different meandered sub-strips of the second meandered strip 206 can be the same or different. The strip widths of the bended strips 208 can be the same or different, and their intervals with the first meandered strip 204 can be the same or different. The dielectric material layer 202 can be made of a dielectric or insulating material, such as a PCB or ceramic material. The first and second meandered strips 204, 206 and the bended strips 208 can be made of a metal, alloy, or other conductive material. For example, they can be made of copper.

Figure 2B:
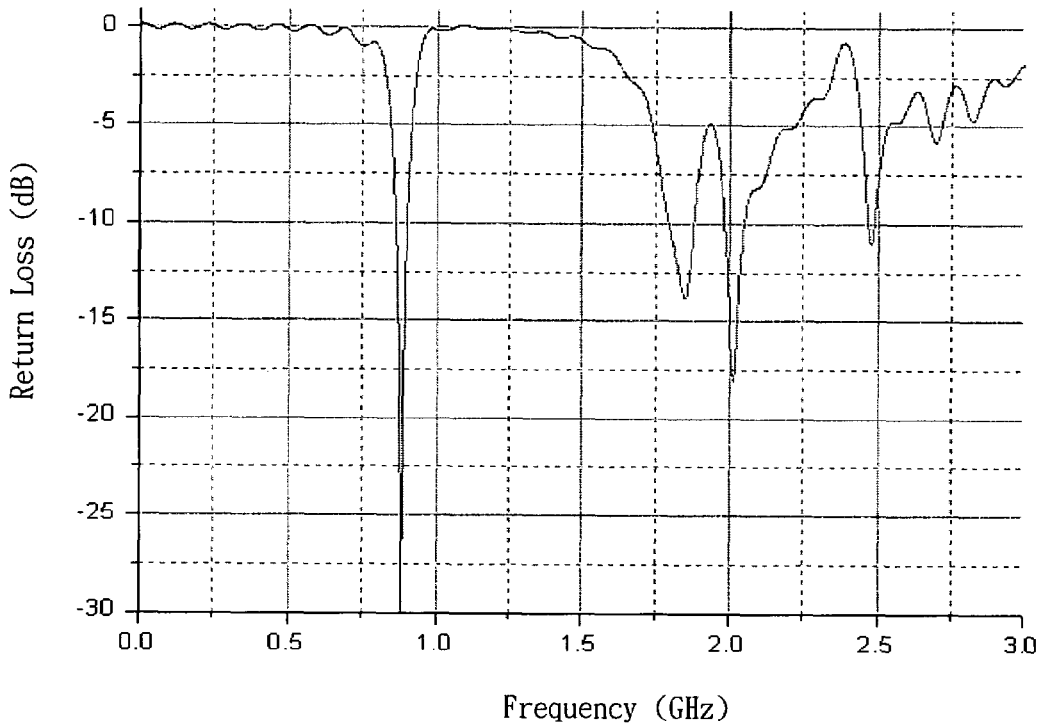
FIG. 2B shows the frequency response of the return loss for FIG. 2A.

FIG. 2B shows the frequency response of the return loss for the chip antenna 200 in FIG. 2A. The vertical axis is the antenna return loss in units of dB; and the horizontal axis is the antenna frequency in units of GHz. The strip widths of the first meandered strip 204, the second meandered strip 206, and the bended strips 208 are all 0.4 mm. The size of the second meandered strip 206 in the first direction 214 is 12 mm. The total size of the first meandered strip 204, the second meandered strip 206, and the bended strip 208 in the second direction 216 is 18 mm. As shown in FIG. 2B, the frequency range of the −10 dB return loss of the chip antenna 200 satisfy the reception requirements of the global system for mobile communications (GSM).

THIRD EMBODIMENT

This embodiment shows that the bended strips can have different shapes. For example, some are inversed L-shaped, while the others are L-shaped. Their intervals with the first meandered strip are not all the same. This renders different antenna frequencies and bandwidths.

Figure 3A:
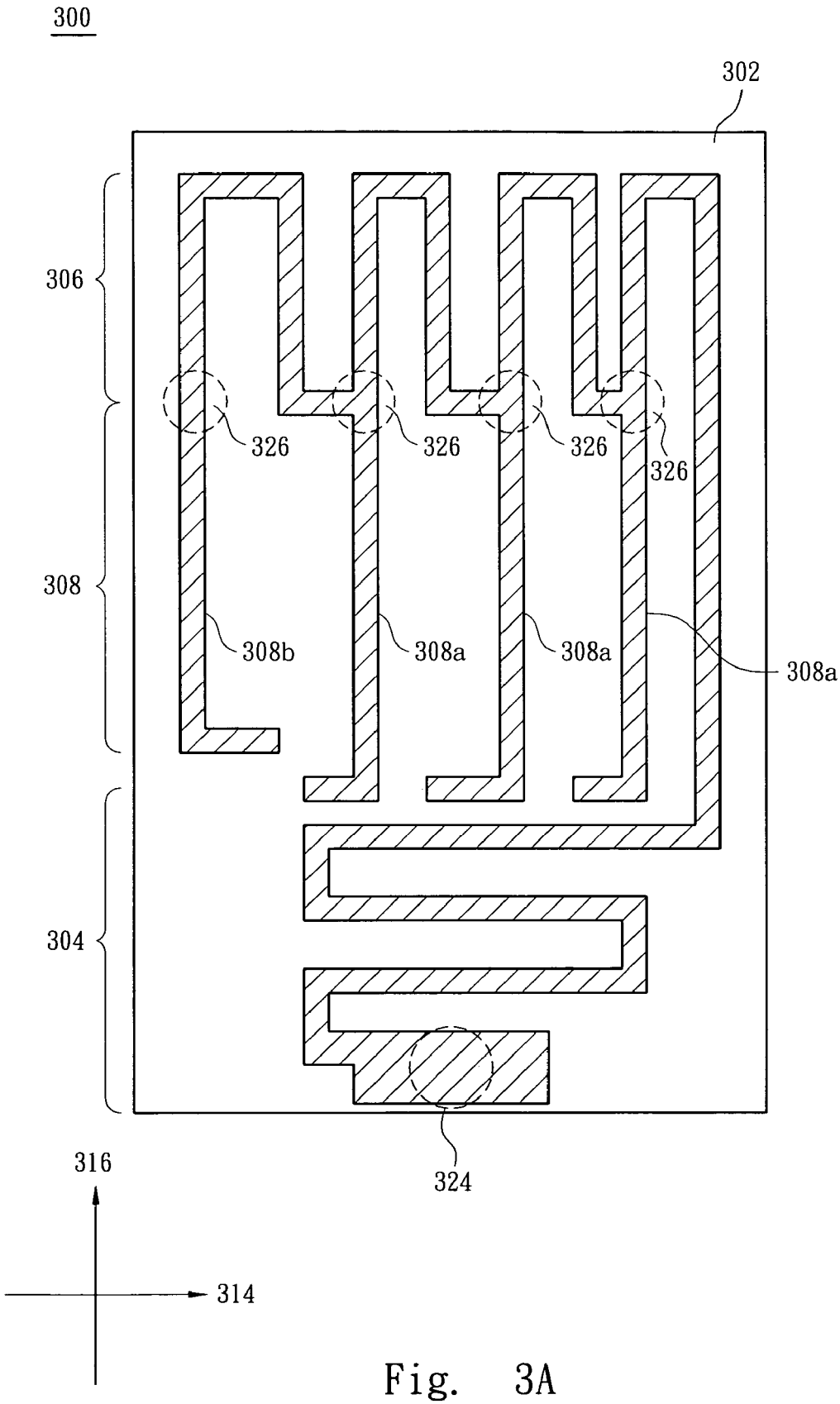
FIG. 3A is a schematic view of the third embodiment of the invention.

As shown in FIG. 3A, one of the bended strips is an L-shaped bended strip. The chip antenna 300 includes a dielectric material layer 302, a first meandered strip 304, a second meandered strip 306, and several bended strips 308. The first meandered strip 304 and the second meandered strip 306 are connected. The bended strips 308 are connected to turns 326 on one same side of the second meandered strip 306.

More explicitly, the bended strips 308 include three inversed L-shaped bended strips 308*a* and one L-shaped bended strip 308*b*. The L-shaped bended strip 308*b* is connected to the outermost U-shaped meandered sub-strip of the second meandered strip 206. The interval between the L-shaped bended strip 308*b* and the first meandered strip 304 is the same as or different from that between the inversed L-shaped bended strips 308*a* and the first meandered strip 304. In this embodiment, these intervals are different.

The chip antenna 300 has its feed on the end 324 of the first meandered strip 304. The strip widths and intervals of different meandered sub-strips of the first meandered strip 304 can be the same or different. The strip widths and intervals of different meandered sub-strips of the second meandered strip 306 can be the same or different. The strip widths of the bended strips 308*a*, 308*b* can be the same or different. Their intervals to the first meandered strip 304 can be the same or different as well. The dielectric material layer 302 is made of a dielectric or insulating material, such as the PCB and ceramic material. The first and second meandered strips 304, 306 and the bended strips 308*a*, 308*b* can be made of a metal, alloy, or other conductive material. For example, they can be made of copper.

Figure 3B:
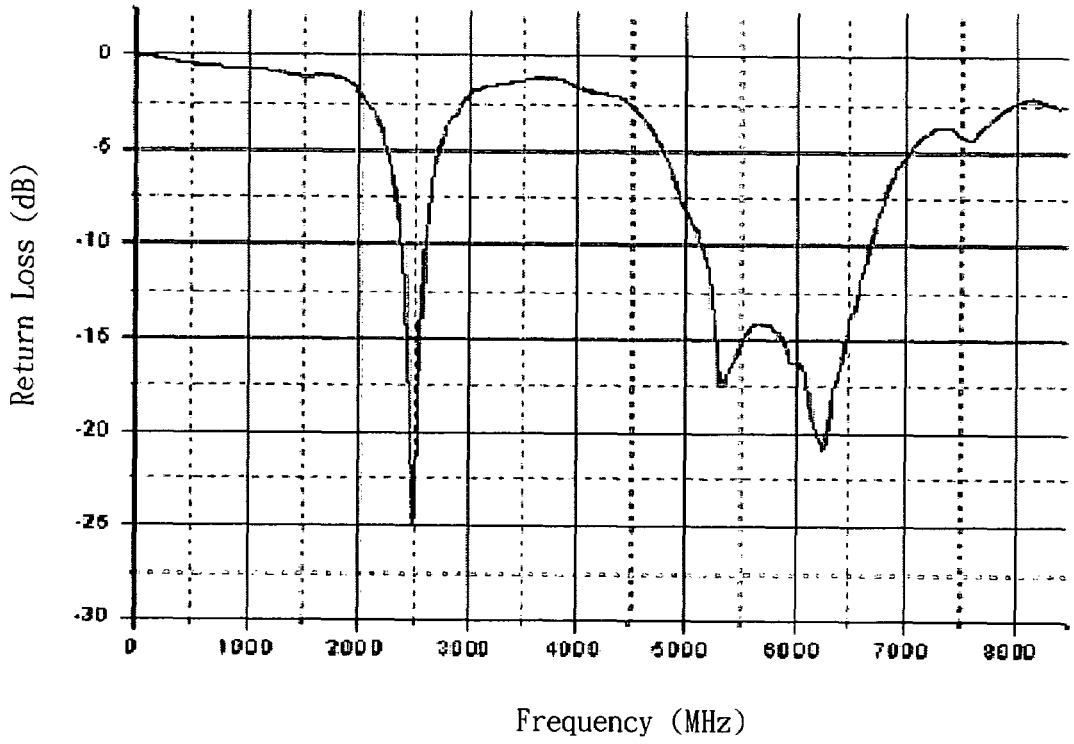
FIG. 3B shows the frequency response of the return loss for FIG. 3A.

FIG. 3B shows the frequency response of the return loss for the chip antenna 300 in FIG. 3A. The vertical axis is the antenna return loss in units of dB; and the horizontal axis is the antenna frequency in units of GHz. The strip widths of the first meandered strip 304, the second meandered strip 306, and the bended strips 308 are all 0.2 mm. The size of the second meandered strip 306 in the first direction 314 is 5 mm. The total size of the first meandered strip 304, the second meandered strip 306, and the bended strip 308 in the second direction 316 is 8 mm. As shown in FIG. 3B, the frequency range of the −10 dB return loss of the chip antenna 300 satisfy the multiple-band reception requirements of the ISM wireless communications (e.g., IEEE802.11a/b/g, Bluetooth, etc).

FOURTH EMBODIMENT

In addition the physical conductive strips, the invention can use a pattern on a conductive material layer to implement all or part of the meandered and bended strips, thus making the chip antenna.

Figure 4A:
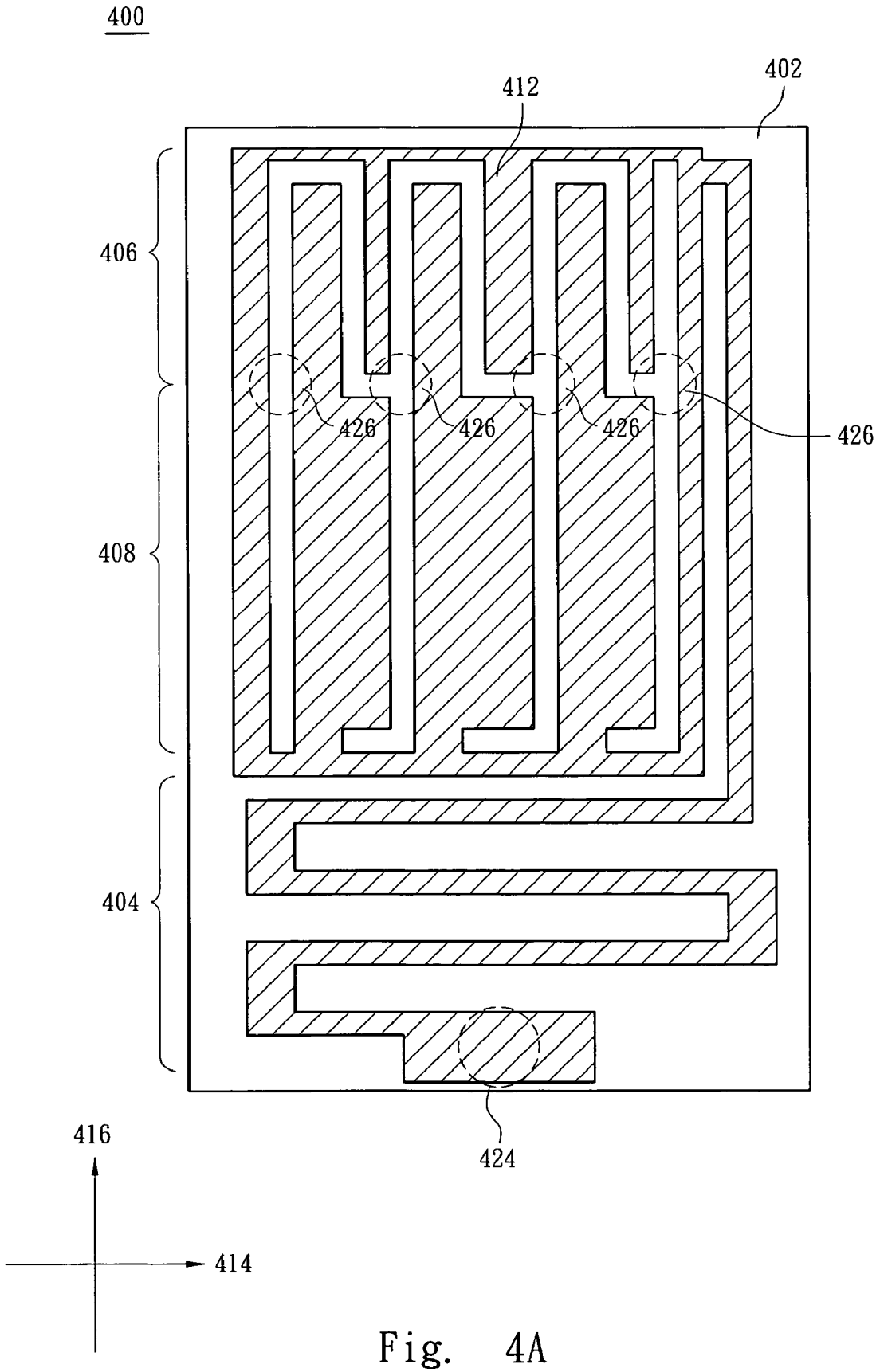
FIG. 4A is a schematic view of the fourth embodiment of the invention.

FIG. 4A shows the fourth embodiment of the invention. A pattern on a metal layer is employed to implement the second meandered and bended strips. As shown in the drawing, the chip antenna 400 includes a dielectric material layer 402, a first meandered strip 404, a second meandered strip 406, and several bended strips 408. In particular, the second meandered strip 406 and the bended strips 408 are formed by the pattern on the conductive material 412, i.e., the empty part thereof. The conductive material layer 412 is disposed on the dielectric material layer 402. The first meandered strip 404 is connected to the conductive material layer 412. The bended strips 408 are connected to several turns 426 on one same side of the second meandered strip 406.

The feed of the chip antenna 400 is located on the end 424 of the first meandered strip 404. The strip widths and intervals of different meandered sub-strips of the first meandered strip 404 can be the same or different. The strip widths (i.e., the widths of the pattern or empty parts) and intervals of different meandered sub-strips of the second meandered strip 406 can be the same or different. The strip widths (i.e., the widths of the pattern or empty parts) of the bended strips 408 can be the same or different. Their intervals to the first meandered strip 404 can be the same or different as well. The dielectric material layer 402 is made of a dielectric or insulating material, such as the PCB and ceramic material. The first meandered strip 404 and the conductive material layer 412 can be made of a metal, alloy, or other conductive material. For example, they can be made of copper.

Figure 4B:
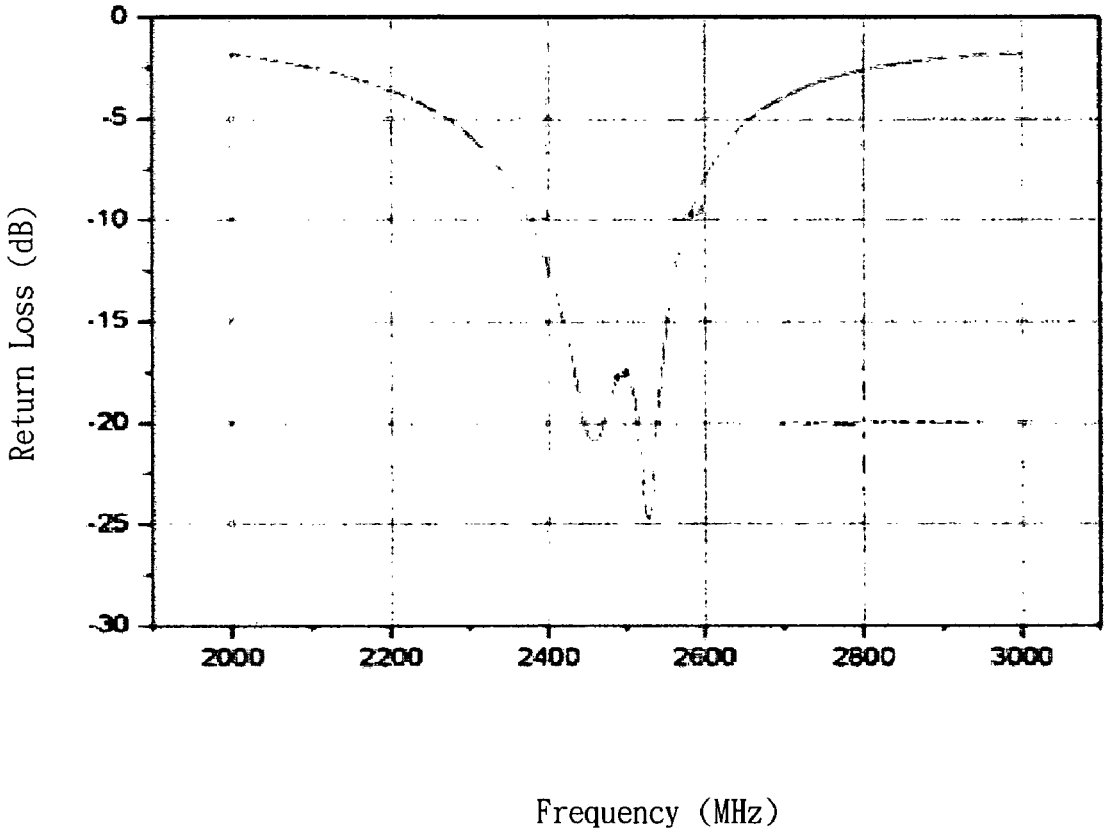
FIG. 4B shows the frequency response of the return loss for FIG. 4A.

FIG. 4B shows the frequency response of the return loss for the chip antenna 400 in FIG. 4A. The vertical axis is the antenna return loss in units of dB; and the horizontal axis is the antenna frequency in units of GHz. The strip widths of the first meandered strip 404, the second meandered strip 406, and the bended strips 408 are all 0.2 mm. The size of the second meandered strip 406 in the first direction 414 is 5 mm. The total size of the first meandered strip 404, the second meandered strip 406, and the bended strip 408 in the second direction 416 is 8 mm. As shown in FIG. 4B, the frequency range of the −10 dB return loss of the chip antenna 400 satisfy the multiple-band reception requirements of the ISM wireless communications (e.g., IEEE802.11a/b/g, Bluetooth, etc).

FIFTH EMBODIMENT

In addition to a single meandered, the first and second meandered strips in this embodiment can have self-surrounding patterns in their specific directions. The number of the bended strips can be smaller than the number of turns. They are connected to only some of the turns.

Figure 5A:
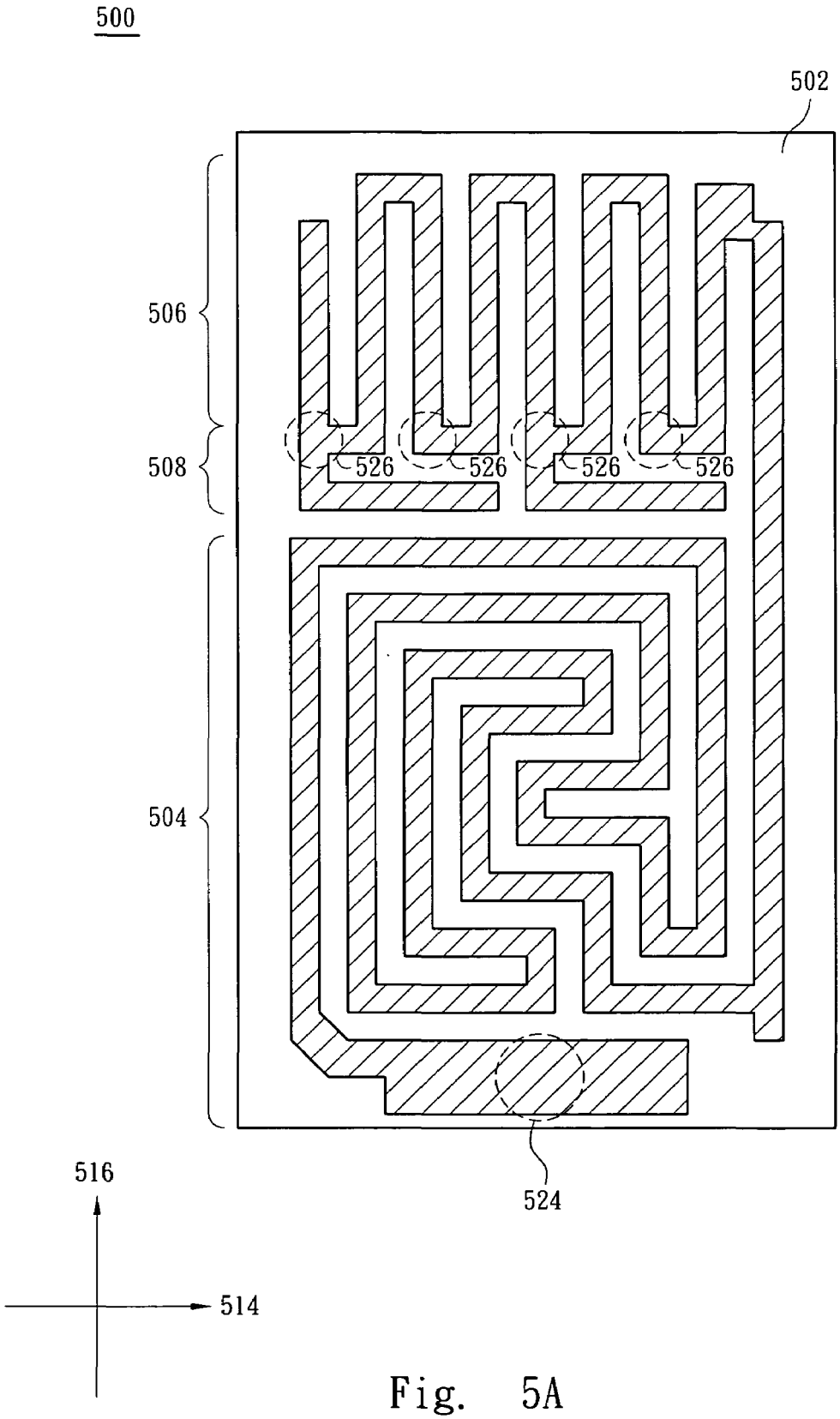
FIG. 5A is a schematic view of the fifth embodiment of the invention.

As shown in FIG. 5A, the first meandered strip has a self-surrounding pattern, where the bended strips are connected to some of its turns. As illustrated in the drawing, the chip antenna 500 includes a dielectric material layer 502, a first meandered strip 504, a second meandered strip 506, and several bended strips 508. The first meandered strip 504 is meandered on the dielectric material layer 502 to form several protruding and receding patterns that match with each other in a first direction 514. The second meandered strip 506 has four turns 526 on one side. The bended strips 508 are two L-shaped bended strips, each of which is connected to a turn 526.

The feed of the chip antenna 500 is located on one end 524 of the first meandered strip 504. The strip widths and intervals of different meandered sub-strips of the first meandered strip 504 can be the same or different. The strip widths and intervals of different meandered sub-strips of the second meandered strip 506 can be the same or different. The strip widths of the bended strips 508 can be the same or different. Their intervals to the first meandered strip 504 can be the same or different as well. The dielectric material layer 502 is made of a dielectric or insulating material, such as the PCB and ceramic material. The first meandered strip 504, the second meandered strip 506, and the bended strips 508 can be made of a metal, alloy, or other conductive material. For example, they can be made of copper.

Figure 5B:
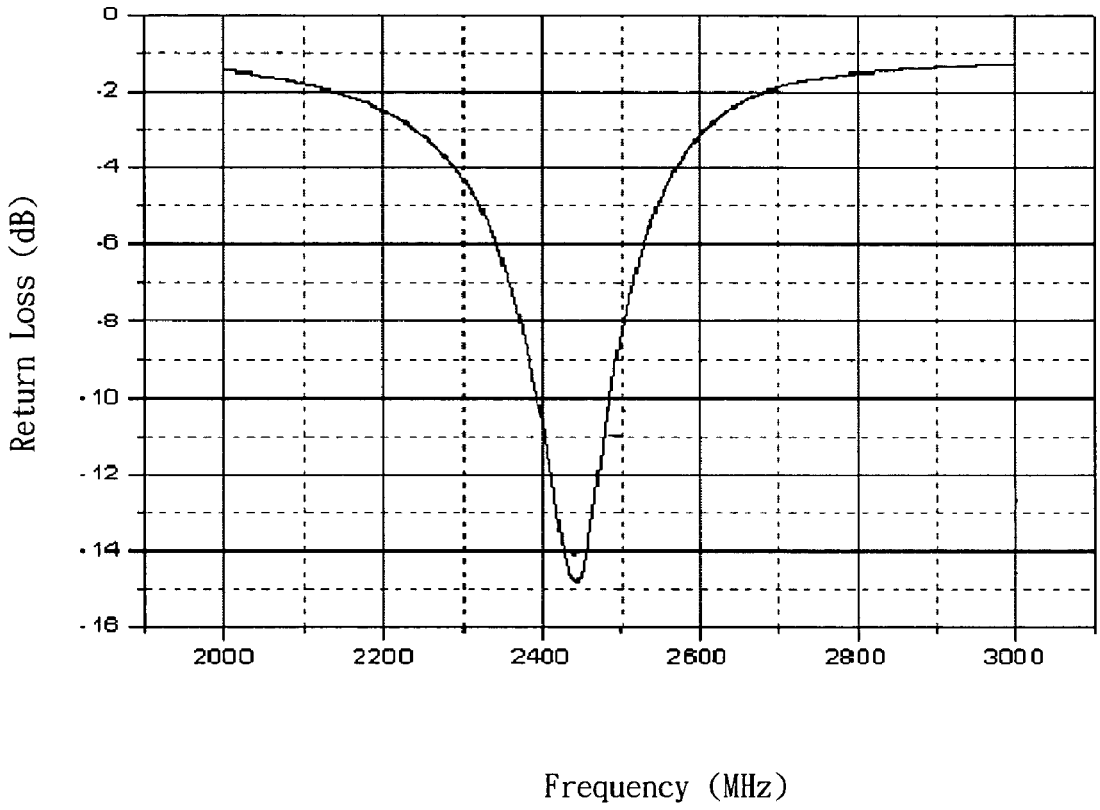
FIG. 5B shows the frequency response of the return loss for FIG. 5A.

FIG. 5B shows the frequency response of the return loss for the chip antenna 500 in FIG. 5A. The vertical axis is the antenna return loss in units of dB; and the horizontal axis is the antenna frequency in units of GHz. The strip widths of the first meandered strip 504, the second meandered strip 506, and the bended strips 508 are all 0.1 mm. The size of the second meandered strip 506 in the first direction 514 is 3 mm. The total size of the first meandered strip 504, the second meandered strip 506, and the bended strip 508 in the second direction 516 is 5.2 mm. As shown in FIG. 5B, the frequency range of the −10 dB return loss of the chip antenna 500 satisfies the multiple-band reception requirements of the ISM wireless communications (e.g., IEEE802.11a/b/g, Bluetooth, etc).

SIXTH EMBODIMENT

At least one connecting strip is added between the meandered sub-strips in this embodiment to change the frequency band or bandwidth of the disclosed chip antenna.

Figure 6A:
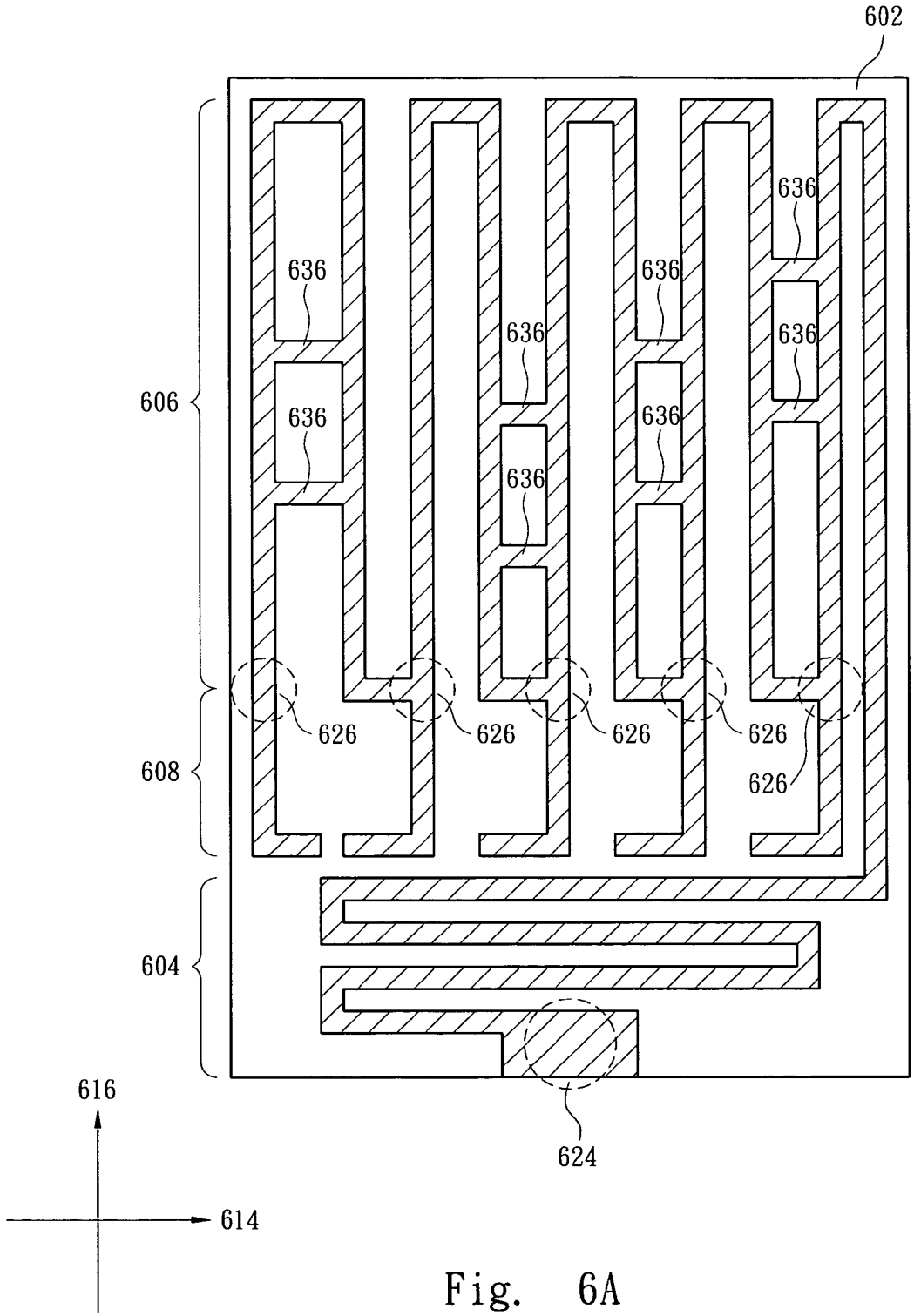
FIG. 6A is a schematic view of the sixth embodiment of the invention.

FIG. 6A shows that several connecting strips are disposed between the meandered sub-strips of the second meandered strip. As shown in the drawing, the chip antenna 600 includes a dielectric material layer 602, a first meandered strip 604, a second meandered strip 606, several bended strips 608, and several connecting strips 636. The first meandered strip 604 and the second meandered strip 606 are connected. The bended strips 608 are connected to several turns 626 on one same side of the second meandered strip 606. Moreover, at least one connecting strip 636 is disposed between the meandered sub-strips of the second meandered strip 606.

The feed of the chip antenna 600 is located on one end 624 of the first meandered strip 604. The strip widths and intervals of different meandered sub-strips of the first meandered strip 604 can be the same or different. The strip widths and intervals of different meandered sub-strips of the second meandered strip 606 can be the same or different. The strip widths of the bended strips 608 can be the same or different. Their intervals to the first meandered strip 604 can be the same or different as well. The dielectric material layer 602 is made of a dielectric or insulating material, such as the PCB and ceramic material. The first and second meandered strips 604, 606, the bended strips 608, and the connecting strips 636 can be made of a metal, alloy, or other conductive material. For example, they can be made of copper.

The connecting strips 636 connected between the meandered sub-strips, i.e. the added strip branches, can increase the radiation efficiency and bandwidth of the chip antenna 600. In other embodiments, the widths of the connecting strips 636 can be the same or different. Different meandered sub-strips can be connected with the same or different amounts of the connecting strips 636. The intervals and connecting position of the connecting strips 636 of different meandered sub-strips can be the same or different.

More explicitly, after a signal enters the feed, multiple branching paths start from the connecting positions of the connecting strips 636 to form many current paths of different lengths. Under this current path structure, the current distribution in shorter current paths has resonances at higher frequencies, whereas that in longer current paths has resonances at lower frequencies. The entire antenna thus achieves the effects of multiple and wide frequency bands.

Figure 6B:
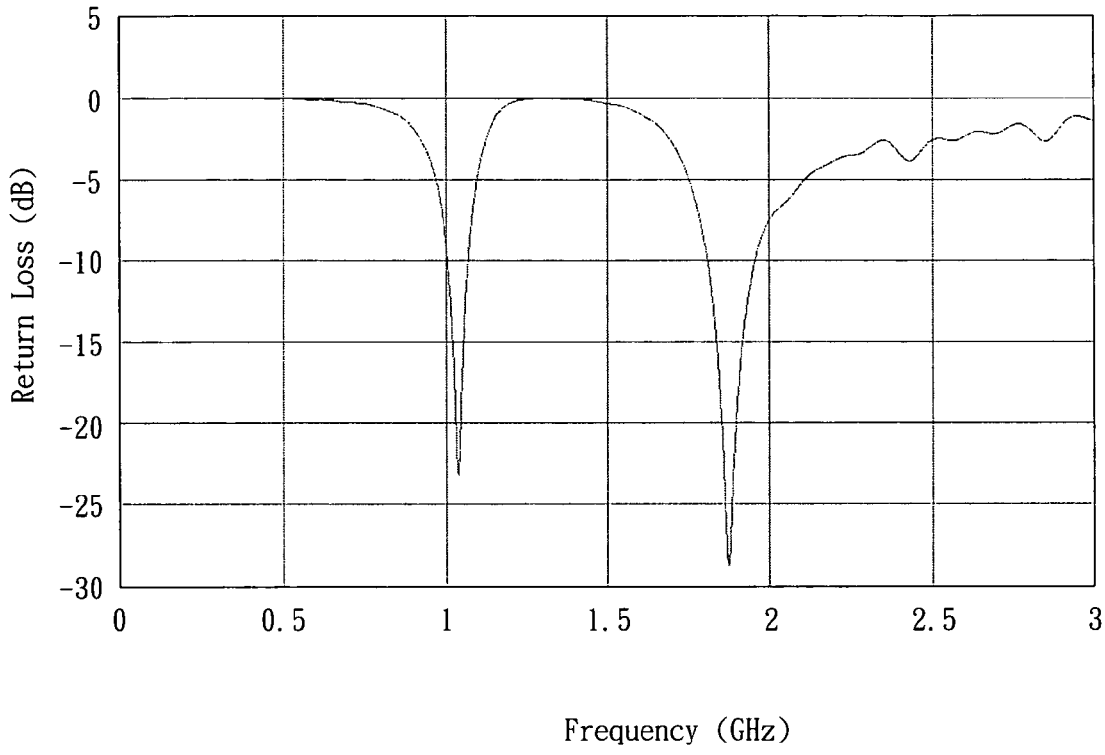
FIG. 6B shows the frequency response of the return loss for FIG. 6A.

FIG. 6B shows the frequency response of the return loss for the chip antenna 600 in FIG. 6A. The vertical axis is the antenna return loss in units of dB; and the horizontal axis is the antenna frequency in units of GHz. The strip widths of the first meandered strip 604, the second meandered strip 606, the bended strips 608, and the connecting strips 636 are all 0.2 mm. The size of the second meandered strip 606 in the first direction 614 is 12 mm. The total size of the first meandered strip 604, the second meandered strip 606, and the bended strip 608 in the second direction 616 is 18 mm. As shown in FIG. 6B, the frequency range of the −10 dB return loss of the chip antenna 600 satisfies the multiple-band reception requirements of the GSM.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A chip antenna, comprising:

a dielectric material layer;

a first meandered strip meandered in a first direction and disposed on the dielectric material layer;

a second meandered strip meandered in a second direction and disposed on the dielectric material layer and connected to the first meandered strip; and a plurality of bended strips connected to a plurality of turns on one side same of the second meandered strip, wherein the intervals between the turns of the second meandered strip are changed to adjust the frequency response, thereby achieving a continuous resonance bandwidth.

2. The chip antenna of claim 1 further comprising a feed connected to the first meandered strip.

3. The chip antenna of claim 1, wherein the strip widths of the first meandered strip, the second meandered strip, and the bended strips are the same or different.

4. The chip antenna of claim 1, wherein the intervals of the first meandered strip are the same or different.

5. The chip antenna of claim 1, wherein the intervals of the second meandered strip are the same or different.

6. The chip antenna of claim 1, wherein the ratio between the size of the first meandered strip in the first direction and the total size of the second meandered strip and the bended strips in the second direction is changed to control the axial ratio thereof.

7. The chip antenna of claim 1, wherein the strip widths of the first meandered strip and the second meandered strip are, changed to adjust the bandwidth thereof.

8. The chip antenna of claim 1, wherein the number of turns in the first meandered strip is changed to shift the frequency response thereof.

9. The chip antenna of claim 1, wherein the number of turns in the second meandered strip is changed to increase the frequency response and thus the bandwidth thereof.

10. The chip antenna of claim 1, wherein the electromagnetic (EM) mutual coupling effect between the bended strips and the first meandered strip is changed to reduce the size of the chip antenna.

11. The chip antenna of claim 1, wherein the first direction is essentially perpendicular to the second direction.

12. The chip antenna of claim 1, wherein the bended strips are L-shaped or inversed L-shaped.

13. The chip antenna of claim 1, wherein the first meandered strip, the second meandered strip, and the bended strips are made of a conductive material.

14. The chip antenna of claim 1 further comprising a conductive material layer on the dielectric material layer, wherein the first meandered strip, the second meandered strip, and the bended strips are all or part of the pattern on the conductive material layer.

15. The chip antenna of claim 1, wherein the first meandered strip has several protruding and receding patterns that match with each other in the first direction.

16. The chip antenna of claim 1, wherein the bended strips are connected to some of the turns.

17. The chip antenna of claim 1, wherein the first meandered strip, the second meandered strip, and the bended strips form a multiple meandered strip set and a plurality of the multiple meandered strip sets are stacked together in the chip antenna.

18. The chip antenna of claim 1 further comprising at least one connecting strip connected between the first meandered strip and the second meandered strip.

* * * * *